United States Patent [19]

Kodama et al.

[11] Patent Number: 4,852,541

[45] Date of Patent: Aug. 1, 1989

[54] DISTRIBUTOR FOR INTERNAL COMBUSTION ENGINE

[75] Inventors: Seiki Kodama; Shigenobu Murase; Haruyuki Matsuo; Hideki Maruhashi; Shigemi Murata; Hidetoshi Miyaji, all of Hyogo, Japan

[73] Assignee: Mitsubishi Denki Kabushiki Kaisha, Tokyo, Japan

[21] Appl. No.: 224,041

[22] Filed: Jul. 25, 1988

[30] Foreign Application Priority Data

Jul. 24, 1987 [JP] Japan ..... 62-185934
Jul. 24, 1987 [JP] Japan ..... 62-185935
Jul. 24, 1987 [JP] Japan ..... 62-114008[U]
Jul. 24, 1987 [JP] Japan ..... 62-114009[U]

[51] Int. Cl.[4] ..... F02P 7/00; F02P 5/14
[52] U.S. Cl. ..... 123/617; 123/414
[58] Field of Search ..... 123/617, 414, 612, 146.5 A

[56] References Cited

U.S. PATENT DOCUMENTS 4,165,726 8/1979 Holmer, Jr. ..... 123/617
4,333,433 6/1982 Mattson ..... 123/617
4,359,978 11/1982 Brammer et al. ..... 123/617
4,462,347 7/1984 Brammer et al. ..... 123/617
4,463,715 8/1984 Brammer ..... 123/617
4,677,946 7/1987 Tamagne ..... 123/617
4,719,883 1/1988 Yokoyama et al. ..... 123/617
4,742,811 5/1988 Okada et al. ..... 123/617
4,747,382 5/1988 Suznki et al. ..... 123/414
4,787,355 11/1988 Masda ..... 123/414

*Primary Examiner*—Raymond A. Nelli
*Attorney, Agent, or Firm*—Sughrue, Mion, Zinn, Macpeak and Seas

[57] ABSTRACT

A distributor for an internal combustion engine includes an ignition timing reluctor provided on a centrifugal spark advance member, ignition timing signal generating means for generating an ignition timing signal by detecting approach and passage of the ignition timing reluctor, a cylinder discriminating reluctor provided on the centrifugal spark advance member, and a cylinder discriminating sensor for generating a cylinder discriminating signal by detecting approach and passage of the cylinder discriminating reluctor. The distributor has a structure for compensating for any imbalance of its rotator. The cylinder discriminating signal is centrifugally advanced in the same way as the ignition timing signal, so that it is possible to reduce the width of the cylinder discriminating signal.

10 Claims, 4 Drawing Sheets

DISTRIBUTOR FOR INTERNAL COMBUSTION ENGINE

BACKGROUND OF THE INVENTION:

1. Field of the Invention

The present invention relates to a distributor for an internal combustion engine. More particularly, the present invention pertains to an improvement in a distributor for an internal combustion engine which is designed to make it possible to generate a cylinder discriminating signal having a reduced width and also to correct the mass imbalance of the rotator.

2. Description of the Related Art

FIG. 5 shows a conventional distributor for an internal combustion engine. In the figure, the reference numeral 1 denotes a distributor housing, 2 a cap, 3 a rotary shaft rotated synchronously with the internal combustion engine, 4 a reluctor for generating a cylinder discriminating signal which is rotated together with the rotary shaft 3 (hereinafter referred to as "cylinder discriminating reluctor"), 5 a sensor disposed to face the reluctor 4 so as to generate a cylinder discriminating signal when the rotary shaft 3 is rotated, 9 a reluctor for detecting ignition timing (hereinafter referred to as "ignition timing reluctor"), 10 a stator constituting a part of the magnetic circuit of the reluctor 9, 6 a magnet signal type generator for generating an ignition signal for each of the cylinders, 7 an ignition timing control unit for controlling the ignition signal generated from the magnet signal type generator 6 on the basis of the positional relationship between the reluctor 9 and the stator 10, that is, according to whether or not the reluctor 9 and the stator 10 face each other, 8 a centrifugal spark advance controller, 81 a governor base fixed to the rotary shaft, 82, 83 weights, and 84 a centrifugal spark advance plate. The centrifugal spark advance plate 84 has a substantially rectangular configuration in plan view, as shown in FIG. 6. The reference numeral 11 denotes a spark advance sleeve loosely fitted on the rotary shaft 3. The ignition timing reluctor 9 is attached to the spark advance sleeve 11. The sensor 5 is attached to the outer surface of the cylindrical part of the distributor housing 1 in such a manner that the sensing surface 51 of the sensor 5 is exposed in the housing 1. The cylinder discriminating reluctor 4 is fixed to the governor base 81 of the centrifugal spark advance controller 8. The functional part of the cylinder discriminating reluctor 4 approaches and passes the sensing surface 51 of the sensor 5 when the rotary shaft 3 is rotated together with the reluctor 4.

In the case of a four-cylinder engine, the rotary shaft 3 is rotated one full turn per two full turns of the crankshaft (not shown) of the engine, so that four ignition timing signals and one cylinder discriminating signal are output per one full turn of the shaft 3. A cylinder which is defined as a standard is detected by the cylinder discriminating signal from the sensor 5, and the signal is supplied to a fuel injecting device corresponding to the cylinder so that fuel is injected when the valve of the cylinder is opened. Then, ignition is conducted on the basis of the ignition timing signal for each of the cylinders.

In the above-described conventional distributor, the ignition timing signal IG which is generated by the ignition timing reluctor 9 is advanced relative to the engine crank angle, whereas the cylinder discriminating signal G generated by the cylinder discriminating reluctor 4 is not advanced, and therefore, in order to detect a cylinder by means of the signal G overlapping the signal IG, the width $\theta_A$ of the signal G must be greater than the entire range of spark advance $\theta$, as shown in FIG. 7. For this reason, the width of the functional part of the cylinder discriminating reluctor 4 must be as large as $\theta_A$, as shown in FIG. 4*b*. Accordingly, the width of the signal generated by the combination of the cylinder discriminating reluctor 4 and the sensor 5 is relatively wide, and the width $\theta_A$ of the cylinder discriminating reluctor 4 is correspondingly wide, which leads to an increase in the amount of mass imbalance during rotation. Under these circumstances, the prior art suffers from the problems of lowered performance and increases in wear at the bearing portions. Further, since rivets 85 are employed to secure the cylinder discriminating reluctor 4 to the governor base 81, the number of required parts is disadvantageously large. The imbalance of the rotator due to the functional part of the cylinder discriminating reluctor hinders smooth rotation of the spark advance sleeve 11 supporting the rotator of the distributor, which has an adverse effect on the centrifugal spark advance characteristics.

SUMMARY OF THE INVENTION

In view of the above-described problems of the prior art, it is a primary object of the present invention to obtain a cylinder discriminating signal which has a reduced width and which is suitable for digital treatment.

It is another object of the present invention to provide a distributor wherein imbalance of mass during rotation is effectively corrected, that is, to minimize the imbalance of the cylinder discriminating reluctor about the rotary shaft.

It is still another object of the present invention to enable the structural imbalance of the cylinder discriminating reluctor to be compensated for by the cylinder discriminating reluctor itself.

It is a further object of the present invention to enable the cylinder discriminating reluctor to be readily secured with a reduced number of parts.

To these ends, the present invention provides a distributor for an internal combustion engine which comprises a rotary shaft rotated synchronously with the internal combustion engine, a spark advance member rotated through a centrifugal spark advance mechanism so that the member revolves relative to the rotary shaft, an ignition timing reluctor provided on the spark advance member, ignition timing signal generating means for generating an ignition timing signal by detecting approach and passage of the ignition timing reluctor, a cylinder discriminating reluctor attached to the spark advance member, and a cylinder discriminating sensor for generating a cylinder discriminating signal by detecting approach and passage of the cylinder discriminating reluctor. Preferably, the cylinder discriminating reluctor is rigidly secured to the centrifugal spark advance plate. The end portion of the cylinder discriminating reluctor at the side thereof which is remote from its functional part is extended and enlarged so as to eliminate the mass imbalance of the cylinder discriminating reluctor. Preferably, said enlarged part is formed in a sector shape. The imbalance of the cylinder discriminating reluct or may be compensated for by the spark advance member instead. More specifically, the end portion of the centrifugal spark advance plate at the side thereof which is remote from the functional part of the cylinder discriminating reluctor may be enlarged so as to eliminate the imbalance. According to one embodiment, the cylinder discriminating sensor is attached to the distributor housing. The spark advance member is defined by a tubular member, i.e., a spark advance sleeve, which is loosely fitted on a rotary shaft rotated synchronously with the internal combustion engine so that the tubular member is able to revolve relative to the shaft. The centrifugal spark advance plate is rigidly secured to this tubular member. A pair of governor weights are centrifugally moved when the rotary shaft is rotated, thus causing the spark advance member to revolve relative to the rotary shaft through the centrifugal spark advance plate. The ignition timing reluctor is provided on the spark advance member. Preferably, the cylinder discriminating reluctor is secured to the spark advance member together with the centrifugal spark advance plate by means of caulking.

In the present invention, the cylinder discriminating reluctor is secured to a spark advance member, for example, a spark advance plate, so that the cylinder discriminating signal is advanced in the same way as the ignition timing signal generated by the ignition timing reluctor. Therefore, the width of the functional part of the cylinder discriminating reluctor can be made narrower than that in the prior art. When the rotator of the distributor is rotated, the mass of the functional part of the cylinder discriminating reluctor is balances by the mass of the sectorial enlarged part of the cylinder discriminating reluctor or the mass of the enlarged part of the centrifugal spark advance plate. If the cylinder discriminating reluctor is secured to the spark advance sleeve together with the centrifugal spark advance plate by means of caulking, it is possible to omit the rivets which have heretofore been required to mount the cylinder discriminating reluctor.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and in which.

DESCRIPTION OF THE PREFERRED EMBODIMENTS

Figure 1:
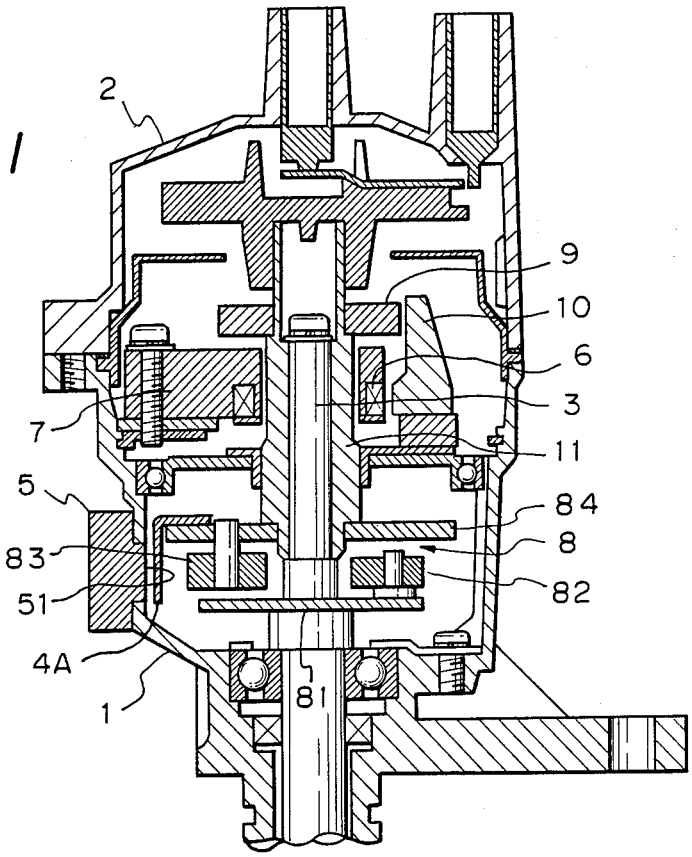
FIG. 1 is a longitudinal cross-sectional view of one embodiment of the distributor for an internal combustion engine according to the present invention.
Figure 5:
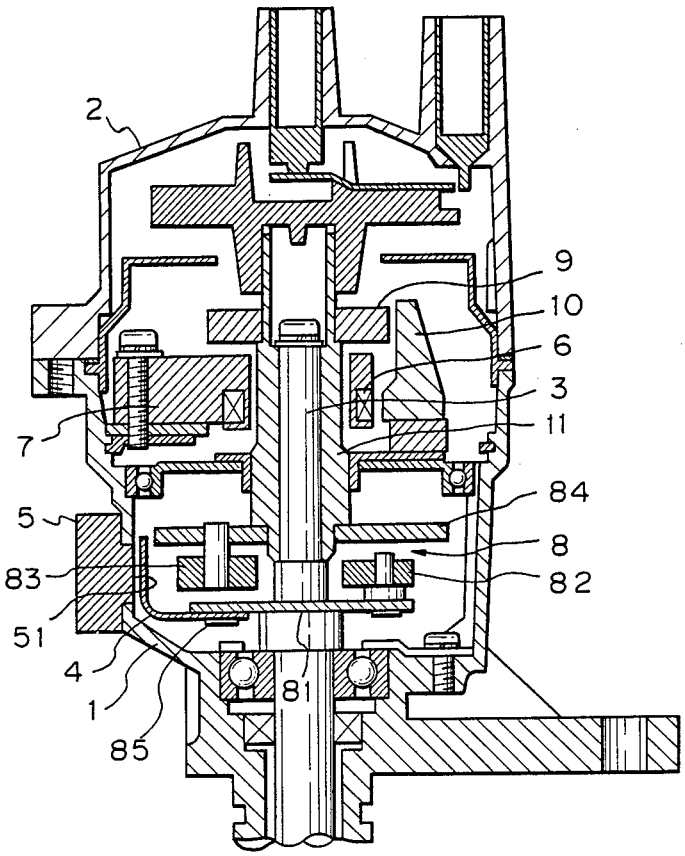
FIG. 5 is a longitudinal cross-sectional view of a conventional distributor for an internal combustion engine.
Figure 6:
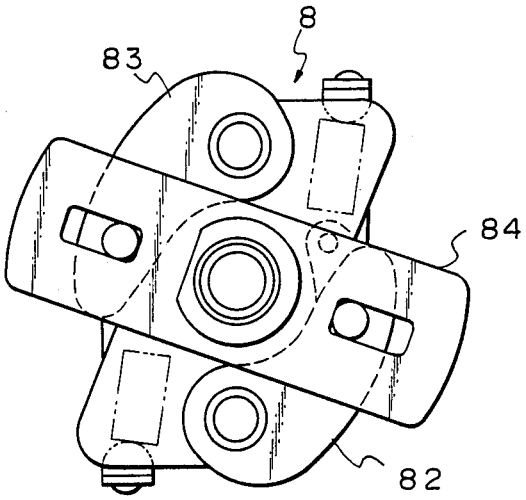
FIG. 6 shows the centrifugal spark advance plate of the prior art shown in FIG. 5.
Figure 7:
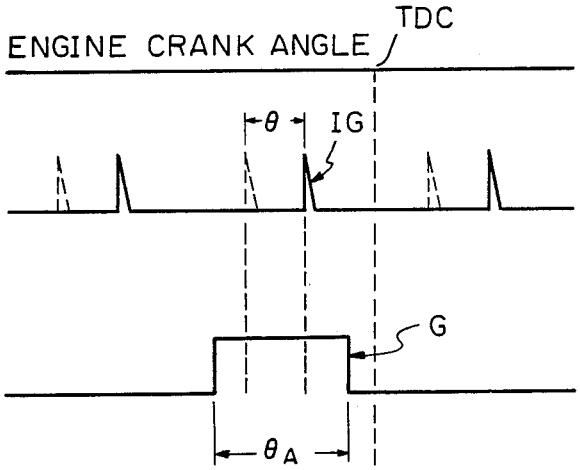
FIG. 7 shows the relationship between the cylinder discriminating signal G and ignition timing signal IG in the prior art.

Referring to FIG. 1, which is a longitudinal cross-sectional view of one embodiment of the distributor for an internal combustion engine according to the present invention, the reference numerals 1 to 3, 6 to 11, 51 and 81 to 83 denote the same elements or portions as those shown in FIG. 5. The reference numeral 4A denotes a cylinder discriminating reluctor according to the present invention which is secured to a spark advance member. More specifically, in the present invention the cylinder discriminating reluctor 4A is attached to a centrifugal spark advance plate 84 so as to rotate together with the spark advance sleeve 11.

Figure 2:
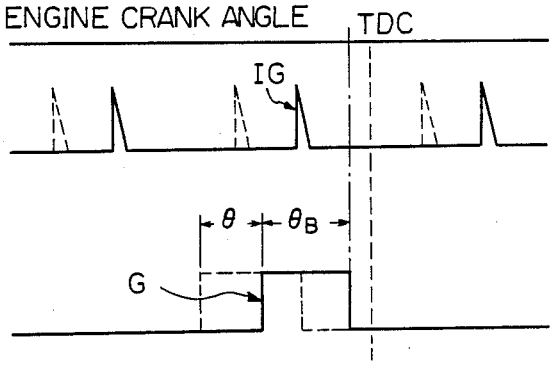
FIG. 2 shows the relationship between the cylinder discriminating signal G and ignition timing signal IG in the present invention.

Referring next to FIG. 2, which shows the relationship between the cylinder discriminating signal G and ignition timing signal IG in the present invention, the signal G is centrifugally advanced in the same way as the signal IG. This is because both the ignition timing reluctor 9 and the cylinder discriminating reluctor 4A are attached to the spark advance sleeve 11.

Figure 4:
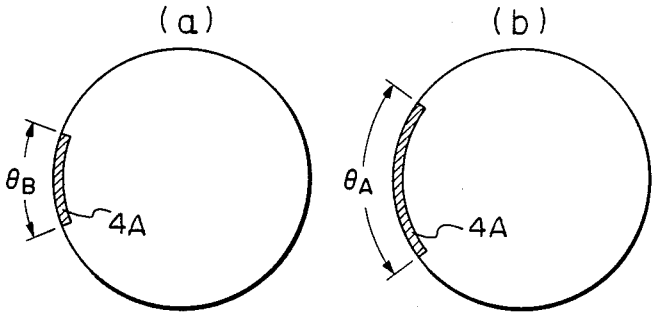
FIGS. 4(*a*) and 4(*b*) show a width comparison between the functional part of the cylinder discriminating reluctor according to the present invention and that of the prior art.

Thus, it is possible to reduce the width of the cylinder discriminating reluctor 4A, as shown in FIG. 4*a*. It should be noted that, since the ignition timing reluctor 9 generates a signal IG in relation to the stator 10 for vacuum spark advance, the width $\theta_B$ of the functional part of the cylinder discriminating reluctor 4A must be sufficiently wide to cover the range of vacuum spark advance; however, the width of the cylinder discriminating signal obtained by the sensor 5 in the present invention is narrower than in the case of the prior art, and therefore it is possible to improve the control tolerances of the associated microcomputer.

Figure 3A:
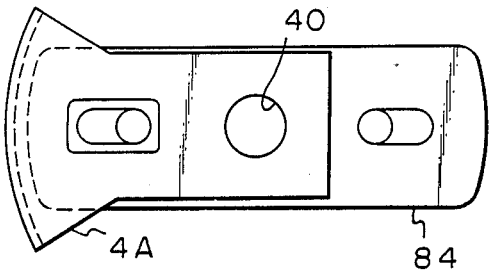
FIGS. 3A, 3B and 3C respectively show structures according to different embodiments which are designed to balance the mass of the functional part of the cylinder discriminating reluctor, in which the cylinder discriminating reluctor or the centrifugal spark advance plate is enlarged.

As shown in FIG. 3A, the arrangement may be such that the cylinder discriminating reluctor 4A is provided with a bore 40 through which it is force-fitted onto the small-diameter portion of the lower end of the spark advance sleeve 11, together with the centrifugal spark advance plate 84, and secured to the sleeve 11 by means of caulking. This arrangement needs no rivets or the like to secure the cylinder discriminating reluctor 4A to the centrifugal spark advance plate 84.

Figure 3B:
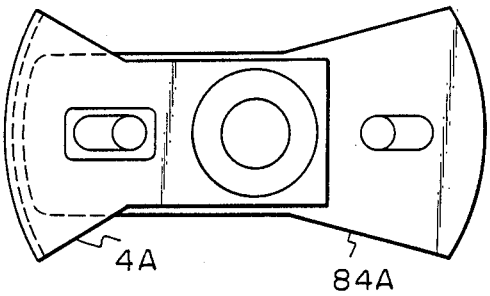

In the arrangement shown in FIG. 3B, the centrifugal spark advance plate 84 has an enlarged part 84A at the side thereof which is remote from the functional part of the cylinder discriminating reluctor 4A. The mass of the enlarged part 84A is set so as to compensate for the centrifugal force produced by the mass of the cylinder discriminating reluctor 4A during rotation. By virtue of this arrangement, it is possible to compensate for imbalance and hence obtain smooth spark advance characteristics. In addition, wear of the bearing portions of the housing 1 is reduced.

Figure 3C:
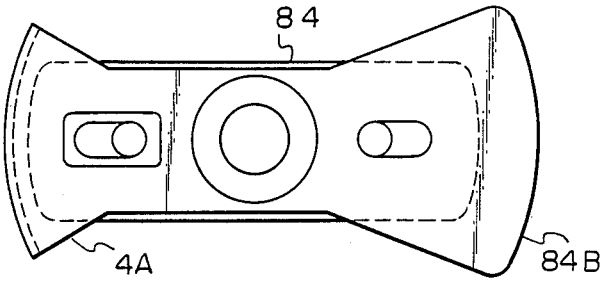

As shown in FIG. 3C, the arrangement may be such that the end portion of the cylinder discriminating reluctor 4A at the side thereof which is remote from its functional part is extended to form a sectorial enlarged part 84B so that the centrifugal force produced by the mass of the functional part of the cylinder discriminating reluctor 4A during rotation is compensated for by the mass of the enlarged part 84B.

An appropriate weight may be secured to the side of the cylinder discriminating reluctor 4A which is remote from the functional part to compensate for the imbalance.

The arrangement may also be such that the centrifugal spark advance plate 84 is provided with a bore or the like at the side thereof which is closer to the functional part of the cylinder discriminating reluctor 4A to reduce the mass and thereby compensate for the imbalance.

It is, as a matter of course, preferable to eliminate imbalance completely, but it suffices to minimize it for practical purposes. Accordingly, the compensation for imbalance in the present invention includes minimization of imbalance.

As has been described above, according to the present invention, the cylinder discriminating reluctor 4A is secured to a spark advance member, that is, both the ignition timing reluctor 9 and the cylinder discriminating reluctor 4A are attached to the spark advance sleeve 11. Therefore, the cylinder discriminating reluctor 4A is advanced together with the ignition timing reluctor 9, and it is possible to narrow the width of the functional part of the cylinder discriminating reluctor 4A. Accordingly, it is possible to reduce the amount of imbalance of the cylinder discriminating reluctor 4A about the rotary shaft 3 an hence to reduce both the weight and size of the cylinder discriminating reluctor 4A. In addition, since the width of the cylinder discriminating signal G is reduced, it is possible to improve the control tolerances of the associated microcomputer.

In one embodiment of the present invention, the cylinder discriminating reluctor 4A is provided with a bore 40 through which it is force-fitted onto the small-diameter portion of the lower end of the spark advance sleeve 11 together with the centrifugal spark advance plate 84 and secured to the sleeve 11 by means of caulking, so that no rivets or the like are required to secure the cylinder discriminating reluctor 4A to the centrifugal spark advance plate B4. Thus it is possible to reduce the number of required parts.

Since, in the present invention, the imbalance of the rotator due to the cylinder discriminating reluctor is effectively corrected, it is possible to obtain smooth spark advance characteristics and reduce wear of the bearing portions supporting the rotator of the distributor.

In the embodiment shown in FIG. 3C, the imbalance of the rotator due to the cylinder discriminating reluctor 4A is compensated for by the reluctor 4A itself. Therefore, it is advantageously possible to use the other members without any need to change the conventional design thereof.

Although the present invention has been described through specific terms, it should be noted here that the described embodiments are not necessarily exclusive and various changes and modifications may be imparted thereto without departing from the scope of the invention which is limited solely by the appended claims.

What is claimed is:

1. A distributor for an internal combustion engine having a rotary shaft rotated synchronously with said internal combustion engine, a centrifugal spark advance member rotated through a centrifugal spark advance mechanism so that said member revolves relative to said rotary shaft, an ignition timing reluctor provided on said centrifugal spark advance member, and ignition timing signal generating means for generating an ignition timing signal by detecting approach and passage of said ignition timing reluctor, wherein the improvement comprises a cylinder discriminating reluctor installed on said centrifugal spark advance member so as to rotate together with it, and a cylinder discriminating sensor for generating a cylinder discriminating signal by detecting approach and passage of said cylinder discriminating reluctor.

2. The distributor according to claim 1, wherein the imbalance of mass due to the installation of said cylinder discriminating reluctor is compensated for by said centrifugal spark advance member.

3. The distributor according to claim 2, wherein said centrifugal spark advance member has an enlarged part at the side thereof which is remote from the functional part of said cylinder discriminating reluctor so as to eliminate the imbalance of mass due to the installation of said cylinder discriminating reluctor.

4. The distributor according to claim 1, wherein the imbalance of mass due to the installation of said cylinder discriminating reluctor is compensated for by said cylinder discriminating reluctor itself.

5. The distributor according to claim 4, wherein the end portion of said cylinder discriminating reluctor at the side thereof which is remote from its functional part is extended and enlarged.

6. The distributor according to claim 5, wherein said cylinder discriminating sensor is attached to the distributor housing.

7. The distributor according to claim 1, wherein said cylinder discriminating reluctor is rigidly secured to a centrifugal spark advance plate.

8. A distributor for an internal combustion engine comprising: a rotary shaft rotated synchronously with said internal combustion engine; a centrifugal spark advance plate rigidly secured to a tubular centrifugal spark advance member loosely fitted on said rotary shaft so that said centrifugal spark advance member is able to revolve relative to said shaft; a governor weight centrifugally moved by rotation of said rotary shaft to cause said centrifugal spark advance member to revolve through said centrifugal spark advance plate; an ignition timing reluctor provided on said centrifugal spark advance member; ignition timing signal generating means for generating an ignition timing signal by detecting approach and passage of said ignition timing reluctor; a cylinder discriminating reluctor secured to said centrifugal spark advance member together with said centrifugal spark advance plate by means of caulking; and a cylinder discriminating sensor for generating a cylinder discriminating signal by detecting approach and passage of said cylinder discriminating reluctor.

9. The distributor according to claim 8, wherein the end portion of said cylinder discriminating reluctor at the side thereof which is remote from its functional part is extended and enlarged so that the imbalance of mass due to the installation of said cylinder discriminating reluctor is compensated for by said cylinder discriminating reluctor itself.

10. The distributor according to claim 9, wherein said cylinder discriminating sensor is attached to the distributor housing.

* * * * *